US009206985B2

(12) United States Patent
Saubert

(10) Patent No.: US 9,206,985 B2
(45) Date of Patent: Dec. 8, 2015

(54) INTEGRATED COOKTOP ASSEMBLY

(71) Applicant: Sears Brands, L.L.C., Hoffman Estates, IL (US)

(72) Inventor: Michael Saubert, Hoffman Estates, IL (US)

(73) Assignee: SEARS BRAND, L.L.C., Hoffman Estates, IL (US)

( * ) Notice: Subject to any disclaimer, the term of this patent is extended or adjusted under 35 U.S.C. 154(b) by 218 days.

(21) Appl. No.: 13/661,762

(22) Filed: Oct. 26, 2012

(65) Prior Publication Data

US 2014/0116416 A1 May 1, 2014

(51) Int. Cl.
*F24C 3/00* (2006.01)
*F24C 3/08* (2006.01)
*F24C 15/10* (2006.01)

(52) U.S. Cl.
CPC ..... *F24C 3/085* (2013.01); *F24C 15/107* (2013.01); *F24C 3/08* (2013.01); *F24C 3/082* (2013.01); *Y10T 29/49348* (2015.01)

(58) Field of Classification Search
CPC ..... F24C 3/08; F24C 3/082; F24C 3/085
USPC ..... 126/39 E, 27
See application file for complete search history.

(56) References Cited

U.S. PATENT DOCUMENTS

| | | | | |
|---|---|---|---|---|
| 1,170,766 | A | 2/1916 | Longfellow | |
| 1,211,567 | A | 1/1917 | Fridlund | |
| 1,463,592 | A | 7/1923 | Robinson | |
| 2,232,482 | A | 2/1941 | Schulz | |
| 2,320,754 | A | 6/1943 | Sherman | |
| 2,506,483 | A | 5/1950 | Bechtold | |
| 3,592,180 | A | 7/1971 | Kweller et al. | |
| 4,834,166 | A * | 5/1989 | Nakano | 164/255 |
| 5,119,802 | A * | 6/1992 | Cherry et al. | 126/39 E |
| 5,158,068 | A * | 10/1992 | Pickering | 126/215 |
| 5,775,316 | A * | 7/1998 | Jones | 126/41 R |
| 5,931,152 | A * | 8/1999 | Fafet et al. | 126/214 R |
| D423,275 | S | 4/2000 | Wilsdorf et al. | |
| 6,236,024 | B1 | 5/2001 | Gotz et al. | |
| 6,318,993 | B1 | 11/2001 | Huang | |
| 6,508,245 | B2 * | 1/2003 | Taplan | 126/39 R |
| 7,150,279 | B2 | 12/2006 | Cheng et al. | |
| 7,322,820 | B2 | 1/2008 | Welton et al. | |
| 7,363,923 | B2 * | 4/2008 | Czajka et al. | 126/39 B |

(Continued)

FOREIGN PATENT DOCUMENTS

| | | |
|---|---|---|
| EP | 0615096 | 9/1994 |
| WO | 2006006882 | 1/2006 |

(Continued)

OTHER PUBLICATIONS

International Search Report and Written Opinion for PCT/US2013/063395, dated Feb. 12, 2014, 7 pages.

*Primary Examiner* — Kenneth Rinehart
*Assistant Examiner* — Gajanan M Prabhu
(74) *Attorney, Agent, or Firm* — McAndrews, Held & Malloy, Ltd.

(57) ABSTRACT

Methods and apparatus are disclosed regarding a gas range and an integrated cooktop assembly. The integrated cooktop assembly may be formed as a single, continuous surface. Some embodiments of the cooktop assembly may include a bowl portion, a burner portion, a grate portion, and a cooktop portion.

28 Claims, 5 Drawing Sheets

(56) References Cited

U.S. PATENT DOCUMENTS

| | | | | |
|---|---|---|---|---|
| 7,650,882 | B2 * | 1/2010 | Little et al. | 126/215 |
| 2005/0056268 | A1 * | 3/2005 | Panchapagesan et al. | 126/39 E |
| 2005/0056633 | A1 * | 3/2005 | Backus et al. | 219/392 |
| 2010/0199968 | A1 * | 8/2010 | Adams et al. | 126/39 E |
| 2011/0236840 | A1 | 9/2011 | Vaglica | |
| 2013/0206132 | A1 * | 8/2013 | Simms, II | 126/25 R |
| 2013/0255663 | A1 * | 10/2013 | Cadima et al. | 126/39 E |

FOREIGN PATENT DOCUMENTS

| | | |
|---|---|---|
| WO | 2007017717 | 2/2007 |
| WO | 2010096889 | 9/2010 |

* cited by examiner

INTEGRATED COOKTOP ASSEMBLY

FIELD OF THE INVENTION

Various embodiments relate to gas ranges and burner assemblies for gas ranges.

BACKGROUND OF THE INVENTION

Conventionally, a gas range includes a cooktop with openings and a separate burner that extends upward through each opening in the cooktop. A conventional gas range further includes a separate grate positioned or otherwise mounted around each of the openings so that a bottom surface of a cooking utensil (e.g., a pot, pan, etc.) may rest on the grate at a position above the burner that extends through the respective opening. Due to such construction, cleaning a conventional gas range can be a laborious task. In order to thoroughly clean the cooktop of the gas range, one must remove each burner and each grate from the cooktop. Moreover, one must separately clean each removed burner and grate. Furthermore, its not uncommon for various materials (e.g., food, crumbs, boiled over liquids, etc.) to seep past the burner, into openings of the cooktop, and onto one or more surfaces positioned below the openings in the cooktop. As such, one may need to lift and/or remove the cooktop from the gas range in order to access and clean such surfaces positioned below the openings in the cooktop.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

Apparatus and methods for integrating aspects of a gas range burner and gas range cooktop are substantially shown in and/or described in connection with at least one of the figures, and are set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Aspects of the present invention are related to systems and methods that integrate various aspects of a gas range. More specifically, certain embodiments of the present invention relate to apparatus and methods that integrate various aspects of a cooktop, burner, and grate of a gas range.

As utilized herein, the terms "exemplary" and "example" refer to a non-limiting example, instance, or illustration. As utilized herein, the term "e.g." introduces a list of one or more non-limiting examples, instances, or illustrations.

Figure 1:
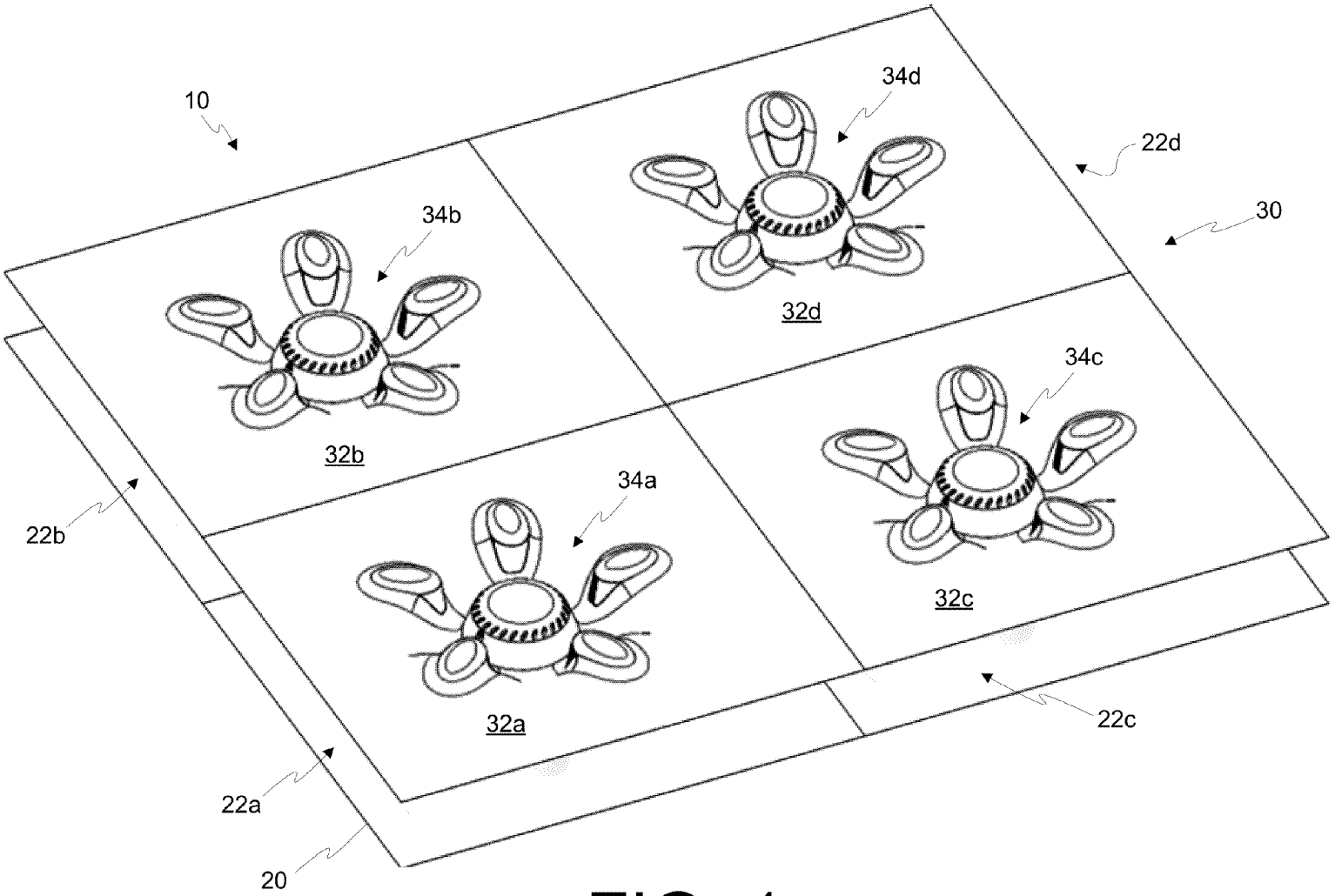
FIG. 1 shows a gas range having a cabinet and cooktop assemblies in accordance with an embodiment of the present invention.

FIG. 1 shows a gas range 10 comprising a range cabinet 20 and a cooktop 30. The range cabinet 20 may include separate compartments 22*a*, 22*b*, 22*c*, 22*d* configured to respectively receive cooktop assemblies 32*a*, 32*b*, 32*c*, 32*d* of the cooktop 30. The gas range 10 is shown comprising four compartments 22*a*, 22*b*, 22*c*, 22*d* and four cooktop assemblies 32*a*, 32*b*, 32*c*, 32*d* that each have a single burner potion 34*a*, 34*b*, 34*c*, 34*d*. The gas range 10, in other embodiments, may comprise a different number of compartments, a different number of cooktop assemblies, and/or a different number of burner portions per cooktop assembly. For example, a cooktop assembly may include two or more burner portions. Similarly, a compartment may accept two or more cooktop assemblies.

Figure 2A:
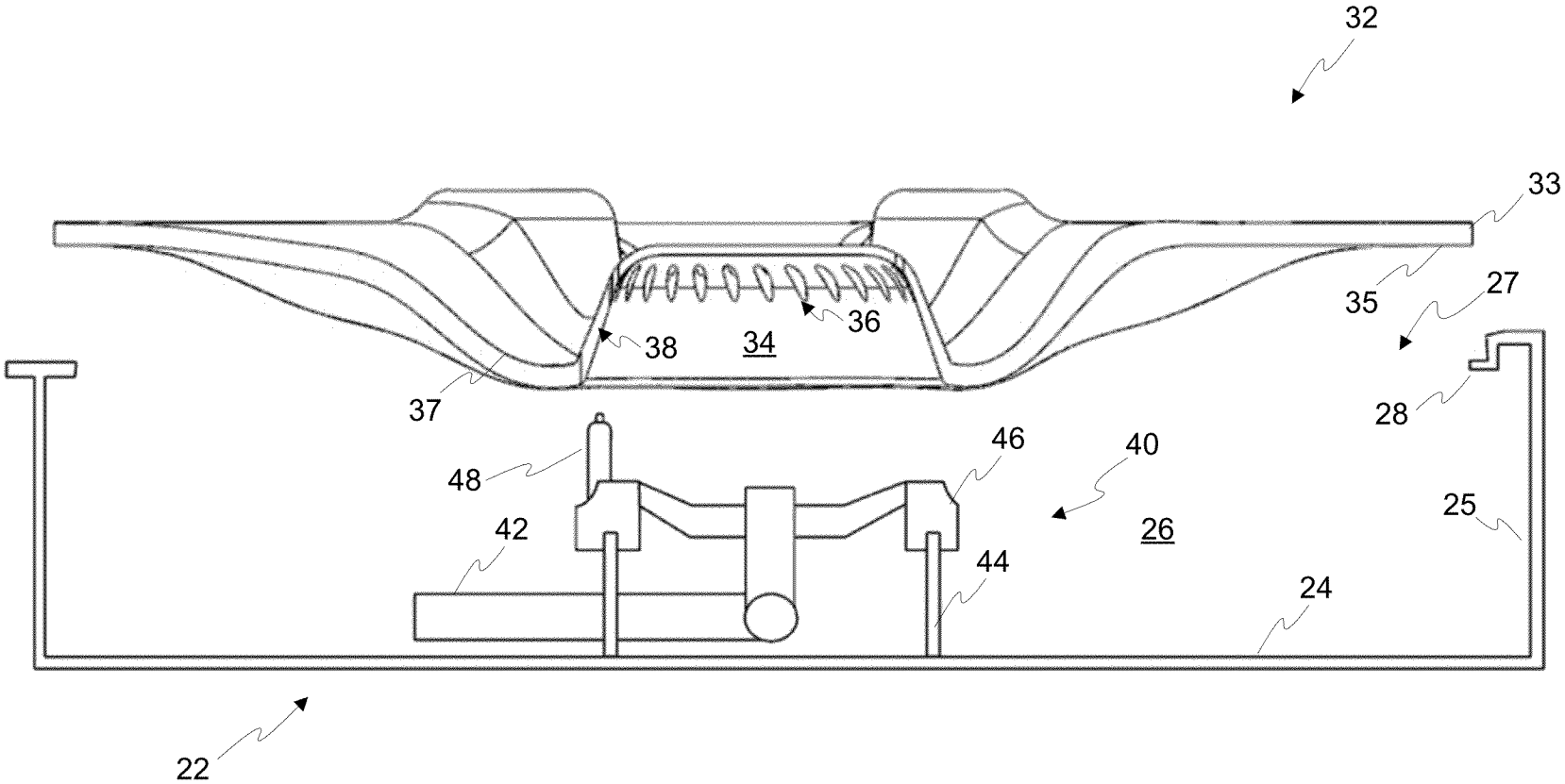
FIGS. 2A and 2B show engagement of a cooktop assembly with a compartment of the gas range shown in FIG. 1.
Figure 2B:
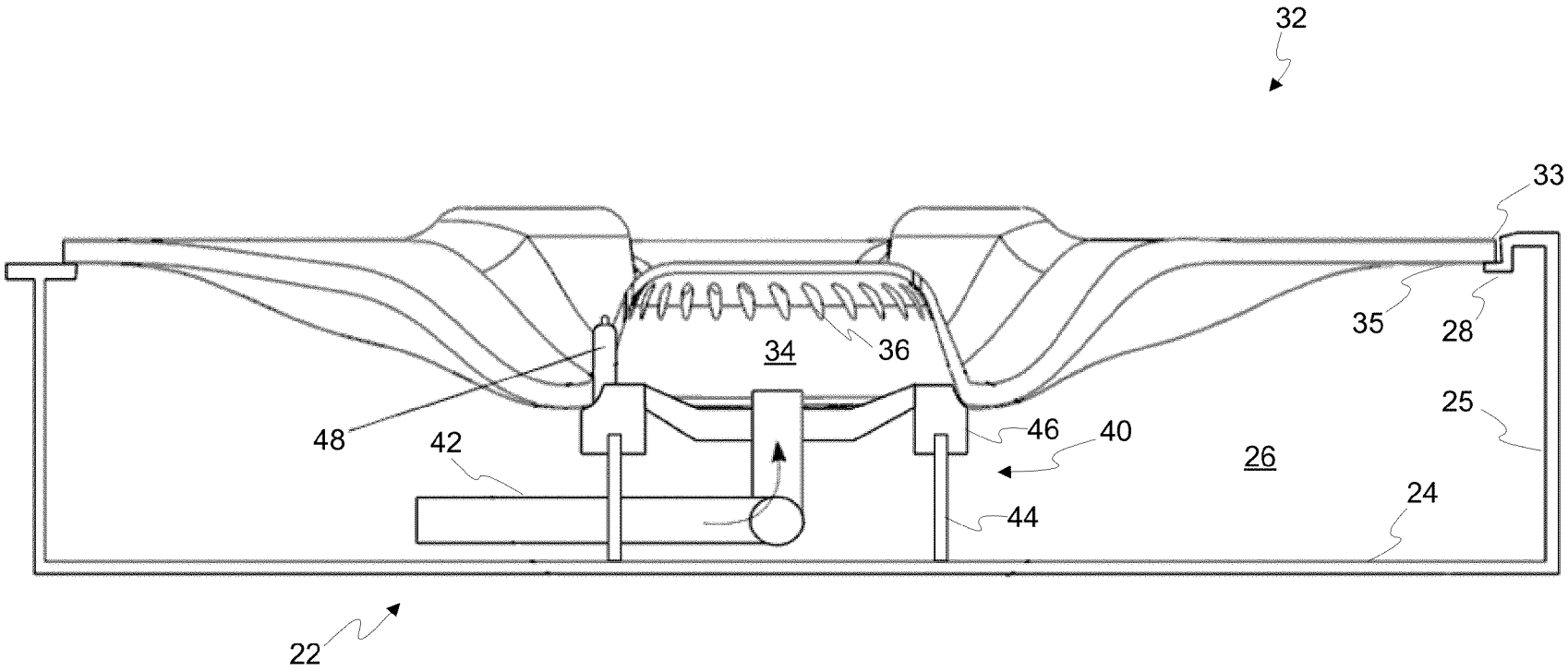

Details regarding a compartment 22 and its engagement with a cooktop assembly 32 are shown in FIGS. 2A and 2B. It should be appreciated that the compartments 22*a*, 22*b*, 22*c*, 22*d* and associated cooktop assemblies 32*a*, 32*b*, 32*c*, 32*d* may be implemented in a manner similar to compartment 22 and cooktop assembly 32 shown in FIGS. 2A and 2B. As shown, the compartment 22 may include a bottom surface 24 and walls 25 that define a cavity 26 dimensioned to house a gas manifold assembly 40. The compartment 22 may further define an opening 27 and flanges 28. The opening 27 may be dimensioned to mate closely with a perimeter 33 of the cooktop assembly 32. Moreover, flanges 28 may extend from walls 25 toward a center of the opening 27 to provide a ledge or lip upon which a lower surface 35 of the received cooktop assembly 32 may rest. The cooktop assembly 32, walls 25, flanges 28, and/or other aspects of the compartment 22 may be dimensioned in regard to one another so that the compartment 22 guides the received cooktop assembly 32 into proper placement with respect to the gas manifold assembly 40.

As shown in FIGS. 2A and 2B, the gas manifold assembly 40 may comprise a delivery tube 42, a stand 44, a ring 46, and an igniter 48. The delivery tube 42 may be configured to deliver gas received from a supply (not shown) to the burner portion 34 of the cooktop assembly 32, thus resulting in a flow of gas from the vents 36 of the burner portion 34. The stand 44 may be configured to lift the ring 46 above the bottom surface 24 and cause the ring 46 to engage and/or closely mate with the received cooktop assembly 32. The stand 44 and the ring 46, therefore, may cause the formation of an open-bottom chamber into which the delivery tube 42 may deliver a gas. Such a configuration permits airflow under the ring 46 and toward the vents 36, thus aiding in delivery and combustion of gas through the vents 36.

The gas manifold assembly 40 may further include an igniter 48 affixed to the ring 46. The igniter 48 may be positioned such that when the cooktop assembly 32 is properly positioned, the igniter 48 extends upwardly through an igniter opening 38 in the burner portion 34 that is proximate vents 36. The igniter 48 may be configured to deliver a spark, electric arc, heat, etc. sufficient to ignite gas flowing through vents 36. Moreover, in some embodiments, the igniter opening 38 may be positioned above a bottom portion 37 of the cooktop assembly 32 to reduce the likelihood that food particles and/or liquids (e.g., from a pan boiling over) seep through the igniter opening 38 and into the compartment 22.

Figure 3:
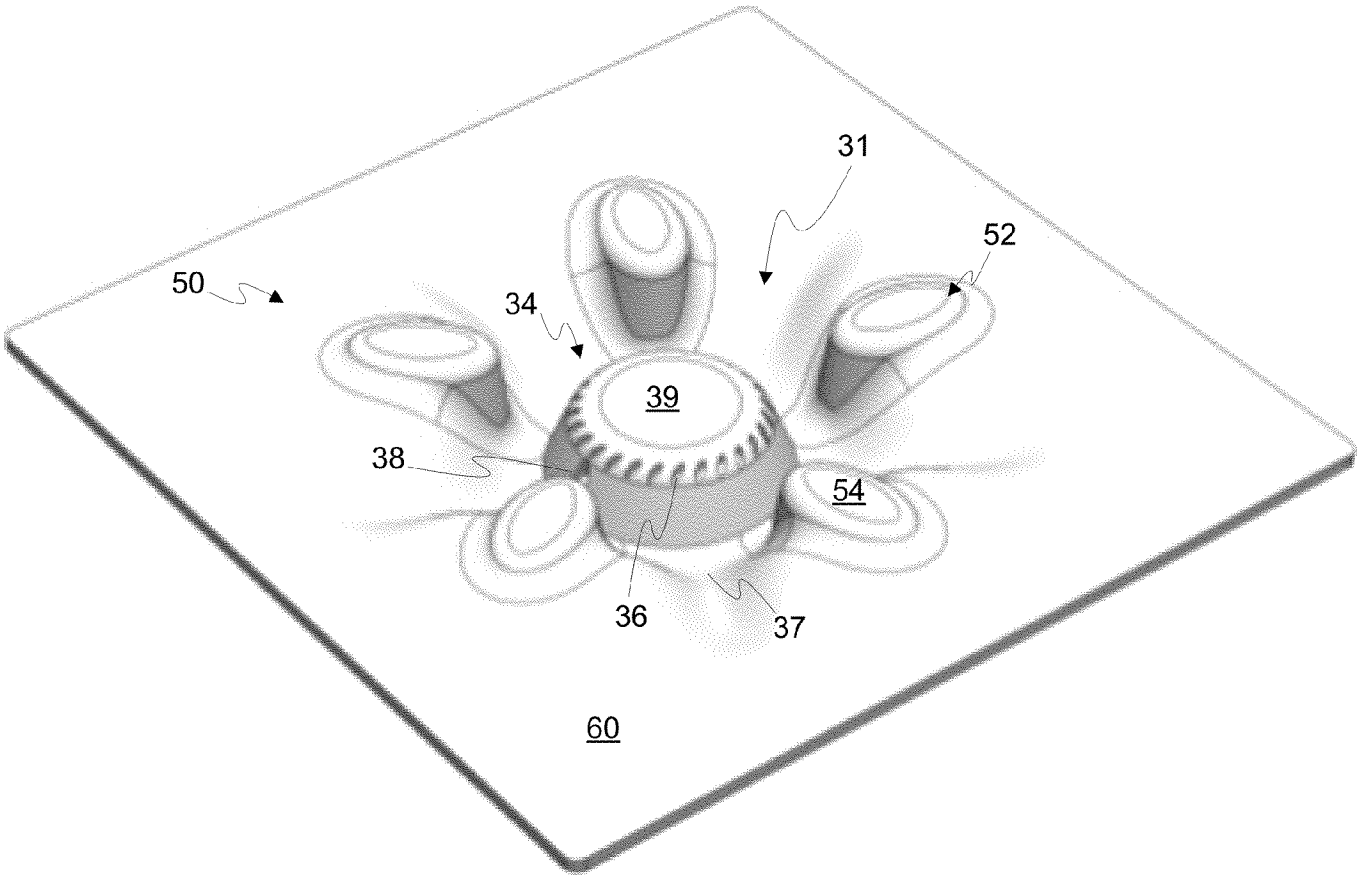
FIG. 3 shows in greater detail a cooktop assembly of the gas range of FIG. 1.

Further aspects of a cooktop assembly 32 are now described with reference to FIG. 3. As shown, the cooktop assembly 32 may comprise a bowl portion 31, a burner portion 34, a grate portion 50, and a cooktop portion 60 which are formed as a single, continuous surface. The cooktop portion 60 may provide a generally planar support surface. In general, the cooktop portion 60 may aid in covering the compartment 22 and may provide structural support for other portions of the cooktop assembly 32. Moreover, the cooktop portion 60 may provide a work surface upon which a user of the gas oven 10 may rest cooking implements and/or other items such as spoons, spatulas, spices, ingredients, etc.

The bowl portion 31 may be formed as a generally rounded, concaved depression into the cooktop portion 60 such that the cooktop portion 60 surrounds the bowl portion 31. The burner portion 34 may be centrally formed within bowl portion 31 such that the burner portion 34 extends upwardly from a bottom portion 37 of the bowl portion 31. As depicted, the vents 36 of the burner portion 34 may be positioned axially about the burner portion 34 and above the bottom portion 37. As a result of such positioning, the bowl portion 31 may accommodate some amount of liquid due to a spill, boiling over, etc. without extinguishing a flame from the burner portion 34 and without causing such liquids to flow into the cabinet 20 via vents 36 and/or igniter opening 38. To this end, the bottom portion 37 of the bowl portion 31 may be sloped away from the burner portion 34 to urge liquids to flow away from the burner portion 34 and toward a perimeter of the bowl portion 31 while retaining such liquids in the bowl portion 31.

The cooktop assembly 32 may further comprise a grate portion 50. The grate portion 50 may include a plurality of stand portions 52. The stand portions 52 may provide a surface upon which a cooking utensil such as a pan, pot, etc. may rest. As shown, each stand portion 52 may provide an elongated upper surface 54 that extends radially from the bowl portion 31 into the cooktop portion 60 in order to raise a cooking utensil resting upon the stand portions 52 above the bowl potion 31 and the cooktop portion 60. However, other configurations of the stand portions 31 are contemplated. For example, one or more stand portions 52 may be positioned fully within the bowl portion 31 or fully external to the bowl portion 31. Furthermore, one or more stand portions 52 may extend axially about the burner portion 34. Moreover, while FIG. 3 depicts the cooktop assembly 32 with five, radially, extending stand portions 52, the cooktop assembly 32 may include a different number of radially, extending stand portions 52 (e.g. three, four, etc.) and/or stand portions 52 having a different geometric shape and/or alignment (e.g., not elongated, not radially extending, etc.). In one embodiment, the plurality of stand portions 52 extend upwardly from the bowl portion 31 beyond a cooktop portion 60 and an upper surface 39 of the burner portion 34. In particular, the stand portions 52 may permit a cooking utensil having a flat bottom surface to rest freely upon the stand portions 52 without also resting upon the upper surface 39. In another embodiment, the stand portions 52 and the burner portion 34 may be configured to cooperatively define a surface upon which a cooking utensil may rest. In such an embodiment, the upper surface 39 may provide further support for a cooking utensil resting upon the stand portions 52.

Figure 4:
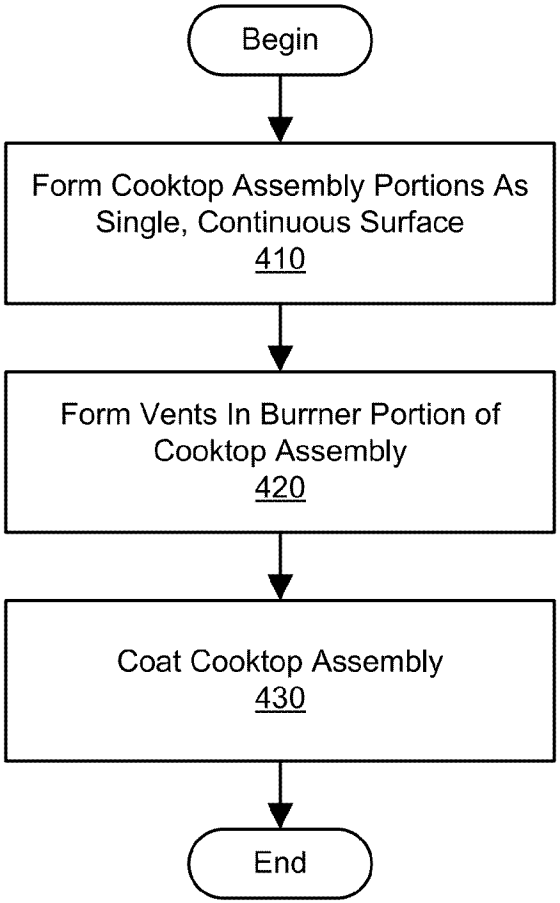
FIG. 4 shows a flowchart of an exemplary method for forming a cooktop assembly of the gas range shown in FIG. 1.

To achieve the above described integration of cooktop assembly portions, the cooktop assembly 32 may be formed via various manufacturing techniques such as, for example, stamping or molding. For instance as shown in the flowchart of FIG. 4, the bowl portion 31, the burner portions 34, the grate portion 50, and cooktop portion 60 at 410 may be formed as a single, continuous surface. For instance, the cooktop assembly 32 may be stamped from a single metal sheet such as steel sheet through one or more stampings that form the various portions of the cooktop assembly 32. Such stampings, therefore, may form the cooktop assembly from the single metal substrate without joining one or more components together. Thus, the cooktop assembly 32 may be formed without seams created from joining separate pieces together. Similarly, the cooktop assembly 32 may be formed via a metal die cast process which forms the various portions of the cooktop assembly 32 as a single die cast piece without seams resulting from joining separate pieces together.

The lack of seams due to the single piece construction may aid in subsequent cleaning. Food and other particles have a tendency of accumulating along seams between components. Cleaning such seams can be laborious due to the multi-surface nature of a seam and the difficulty of a cloth or other cleaning implement making contact with food and other particles embedded within such a seam.

At 420, the vents 36 may be formed in the burner portion 34. For example, the vents 36 may be punched or milled in the manufacturing process. While the vents 36 may be formed after forming the bowl portion 31, the burner portion 34, the grate portion 50, and cooktop portion 60 at 410, the vents **36*a* in other embodiments may be formed as part of the forming process of 410 or before the forming process of 410. For example, progressively stamping the a metal sheet during the forming process of 410 may also punch out vents 36**.

The stamped or cast cooktop assembly 32 may then be coated at 430. For example, the stamped or cast cooktop assembly 32 may be coated with porcelain or another material during a firing process that forms a glaze over the cooktop assembly 32. Such a glaze may help protect the cooktop assembly 32 and aid in its subsequent cleaning.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A cooktop assembly, comprising:

a single, continuous surface comprising a bowl portion, a burner portion, and a grate portion;

wherein the single, continuous surface forms the bowl portion, the burner portion, and the grate portion without seams;

wherein the burner portion extends upward from a bottom surface of the bowl portion and includes a plurality of vents to deliver a gas flame;

wherein the grate comprises a plurality of stand portions configured to support a bottom surface of a cooking utensil placed upon the grate portion; and wherein the single, continuous surface comprises a single, metal sheet formed to comprise the bowl portion, the burner portion, and the grate portion.

2. The cooktop assembly of claim 1, wherein the single, continuous surface is covered with a coating.

3. The cooktop assembly of claim 1, wherein:

the burner portion further includes an igniter opening configured to receive an igniter; and the igniter opening and vents are positioned above a bottom surface of the bowl portion.

4. The cooktop assembly of claim 1, wherein at least a portion of the bottom surface of the bowl portion slopes away from the burner portion.

5. The cooktop assembly of claim 1, wherein the burner portion is further configured to aid the plurality of stand portions in supporting the bottom surface of the cooking utensil when placed upon the grate portion.

6. The cooktop assembly of claim 1, further comprising a cooktop portion into which the bowl portion is formed.

7. The cooktop assembly of claim 1, further comprising:

a cooktop portion into which the bowl portion is formed; and wherein at least one stand portion extends radially from the bowl portion into the cooktop portion.

8. The cooktop assembly of claim 1, further comprising:

a cooktop portion into which the bowl portion is formed; and wherein at least one stand portion extends axially about the burner portion.

9. The cooktop assembly of claim 1, wherein the burner portion is configured to closely mate with a ring of a gas manifold assembly to form an open-bottom chamber configured to receive a gas and deliver the received gas to the plurality of vents.

10. A cooktop assembly, comprising:

a single, continuous surface comprising a bowl portion, a burner portion, and a grate portion;

wherein the single, continuous surface forms the bowl portion, the burner portion, and the grate portion without seams;

wherein the burner portion extends upward from a bottom surface of the bowl portion and includes a plurality of vents to deliver a gas flame;

wherein the grate portion comprises a plurality of stand portions configured to support a bottom surface of a cooking utensil placed upon the grate portion; and wherein the single, continuous surface comprises a single die cast piece molded to comprise the bowl portion, the burner portion, and the grate portion.

11. The cooktop assembly of claim 10, wherein the single, continuous surface is covered with a coating.

12. The cooktop assembly of claim 10, wherein:

the burner portion further includes an igniter opening configured to receive an igniter; and the igniter opening and vents are positioned above a bottom surface of the bowl portion.

13. The cooktop assembly of claim 10, wherein at least a portion of the bottom surface of the bowl portion slopes away from the burner portion.

14. The cooktop assembly of claim 10, wherein the burner portion is further configured to aid the plurality of stand portions in supporting the bottom surface of the cooking utensil when placed upon the grate portion.

15. The cooktop assembly of claim 10, further comprising a cooktop portion into which the bowl portion is formed.

16. The cooktop assembly of claim 10, further comprising:

a cooktop portion into which the bowl portion is formed; and wherein at least one stand portion extends radially from the bowl portion into the cooktop portion.

17. The cooktop assembly of claim 10, further comprising:

a cooktop portion into which the bowl portion is formed; and wherein at least one stand portion extends axially about the burner portion.

18. The cooktop assembly of claim 10, wherein the burner portion is configured to closely mate with a ring of a gas manifold assembly to form an open-bottom chamber configured to receive a gas and deliver the received gas to the plurality of vents.

19. A method, comprising:

forming a bowl portion, a burner portion, and a grate portion of a cooktop assembly as a single, continuous surface without seams, wherein the burner portion extends upward from a bottom surface of the bowl portion and includes a plurality of vents to deliver gas flame, and wherein the grate comprises a plurality of stand portions configured to support a bottom surface of a cooking utensil placed upon the grate portion; and coating the formed cooktop assembly;

wherein said forming comprises progressively stamping a single, metal sheet to form the bowl portion, the burner portion, and the grate portion of the cooktop assembly.

20. The method of claim 19, further comprising punching vents into the burner portion of the cooktop assembly.

21. A method, comprising:

forming a bowl portion, a burner portion, and a grate portion of a cooktop assembly as a single, continuous surface without seams, wherein the burner portion extends upward from a bottom surface of the bowl portion and includes a plurality of vents to deliver gas flame, and wherein the grate portion comprises a plurality of stand portions configured to support a bottom surface of a cooking utensil placed upon the grate portion; and coating the formed cooktop assembly;

wherein said forming comprises molding the bowl portion, the burner portion, and the grate portion of the cooktop assembly via a single die cast.

22. The method of claim 21, further comprising punching vents into the burner portion of the cooktop assembly.

23. A gas range, comprising:

a cabinet having a plurality of compartments;

a plurality of gas manifold assemblies;

a plurality of cooktop assemblies, each cooktop assembly comprising a single, continuous surface comprising a bowl portion, a burner portion, and a grate portion, wherein the burner portion extends upward from a bottom surface of the bowl portion and includes a plurality of vents to deliver a gas flame, and wherein the grate portion comprises a plurality of stand portions configured to support a bottom surface of a cooking utensil placed upon the grate portion;

wherein each compartment comprises at least one side wall that is configured to separate the plurality of compartments, receive a respective cooktop assembly of the plurality of cooktop assemblies, and position the received cooktop assembly such that the burner portion of the received cooktop assembly is properly aligned with a respective gas manifold assembly of the plurality of gas manifold assemblies;

wherein each gas manifold assembly comprises a delivery tube, a stand, and a ring;

wherein the stand is configured to lift the ring above a bottom surface of a respective compartment and cause the ring to closely mate with a respective cooktop assembly to form an open-bottom chamber;

wherein the delivery tube is configured to deliver gas into the open-bottom chamber; and wherein the open-bottom chamber is configured to permit airflow under the ring to aid in delivery of gas from the open-bottom chamber to the plurality of vents of the respective cooktop assembly.

24. The gas range of claim 23, wherein:

the burner portion of each cooktop assembly further includes an igniter opening configured to receive an igniter of a respective gas manifold assembly; and each compartment is further configured to align the igniter of the respective gas manifold assembly with the igniter opening of the received cooktop assembly.

25. The gas range of claim 23, wherein the burner portion of each cooktop assembly is further configured to aid the plurality of stand portions in supporting the bottom surface of the cooking utensil when placed upon the grate portion.

26. The gas range of claim 23, wherein each cooktop assembly further comprises a cooktop portion into which the bowl portion is formed.

27. The gas range of claim 23, wherein:

each cooktop assembly further comprises a cooktop portion into which the bowl portion is formed; and at least one stand portion of each cooktop assembly extends radially from the bowl portion into the cooktop portion.

28. The gas range of claim 23, wherein:

each cooktop assembly further comprises a cooktop portion into which the bowl portion is formed; and at least one stand portion of each cooktop assembly extends axially about the burner portion.

* * * * *